US008082685B2

(12) United States Patent
Sartor et al.

(10) Patent No.: US 8,082,685 B2
(45) Date of Patent: Dec. 27, 2011

(54) INSOLE HAVING PUNCTURE-RESISTANT PROPERTIES FOR SAFETY FOOTWEAR

(75) Inventors: Leo Sartor, Montebelluna (IT); Mario Callegari, Biadene di Montebelluna (IT); Angelo Montemurro, Chiavenna (IT)

(73) Assignee: Novation S.p.A., Montebelluna (TV) (IT)

( * ) Notice: Subject to any disclaimer, the term of this patent is extended or adjusted under 35 U.S.C. 154(b) by 856 days.

(21) Appl. No.: 12/090,712

(22) PCT Filed: Jan. 10, 2006

(86) PCT No.: PCT/IT2006/000006

§ 371 (c)(1),
(2), (4) Date: Jun. 23, 2008

(87) PCT Pub. No.: WO2007/046118

PCT Pub. Date: Apr. 26, 2007

(65) Prior Publication Data

US 2008/0282581 A1 Nov. 20, 2008

(30) Foreign Application Priority Data

Oct. 19, 2005 (WO) ..... PCT/IT2005/000610

(51) Int. Cl.
*A43B 13/38* (2006.01)

(52) U.S. Cl. ..... 36/102; 36/44; 36/30 R; 36/73

(58) Field of Classification Search ..... 36/4, 44, 36/43, 30 R, 102, 103, 73
See application file for complete search history.

(56) References Cited

U.S. PATENT DOCUMENTS

| | | | |
|---|---|---|---|
| 5,832,634 | A | 11/1998 | Wong |
| 6,151,803 | A | 11/2000 | Charles |
| 2004/0221489 | A1 | 11/2004 | Hung |

FOREIGN PATENT DOCUMENTS

| | | | |
|---|---|---|---|
| EP | 0667108 | A | 8/1995 |
| WO | 01/51263 | A | 7/2001 |

OTHER PUBLICATIONS

International Search Report and Written Opinion in PCT/IT2006/000006 mailed Jul. 13, 2006.
International Preliminary Report on Patentability in PCT/IT2006/000006 mailed Oct. 15, 2007.

*Primary Examiner* — Ted Kavanaugh
(74) *Attorney, Agent, or Firm* — Kristina Castellano; Castellano PLLC

(57) ABSTRACT

A insole (1) having puncture-resistant properties for safety footwear, comprising an anterior portion (2) extending from a toe region (3) to a metatarsal region (4) of the insole and a posterior portion (5) extending from the metatarsal region to a heel region (6) longitudinally opposite the toe region. The posterior portion (5) comprises at least one substantially rigid layer (8) made of composite material formed from a fibre-reinforced polymer matrix and the anterior portion (2) is formed of a substantially flexible material comprising at least one layer (7) formed of polymer fibres having enhanced puncture-resistant properties.

24 Claims, 1 Drawing Sheet

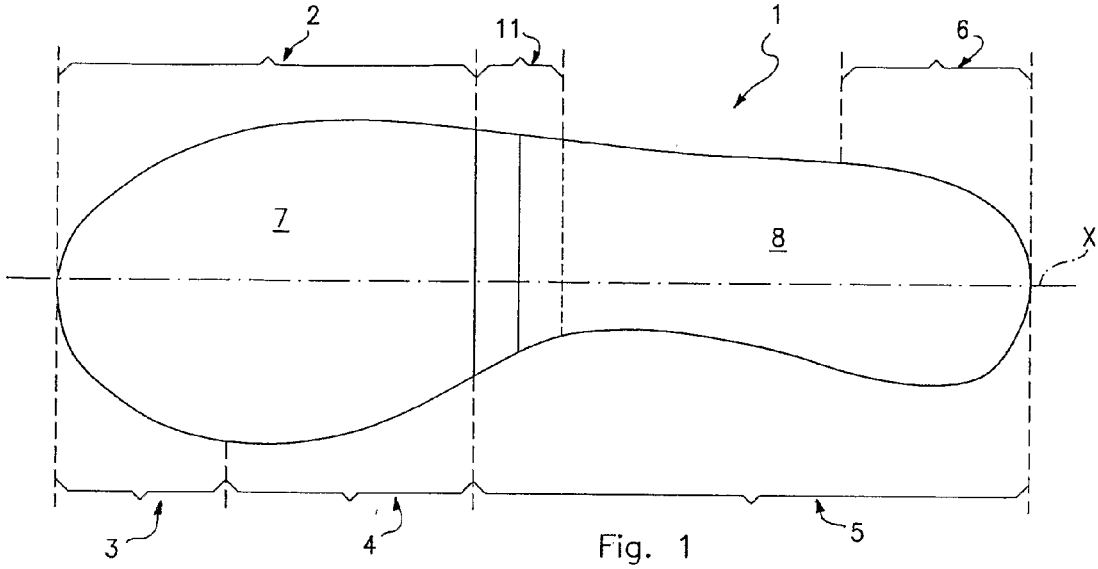
Fig. 1
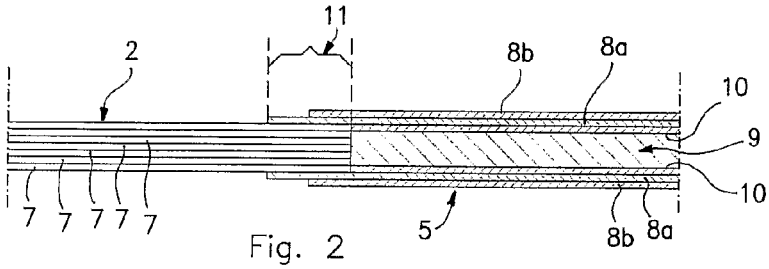
Fig. 2
Fig. 3
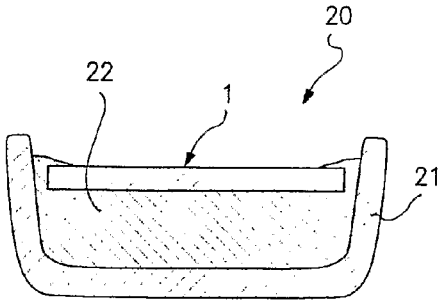
Fig. 4
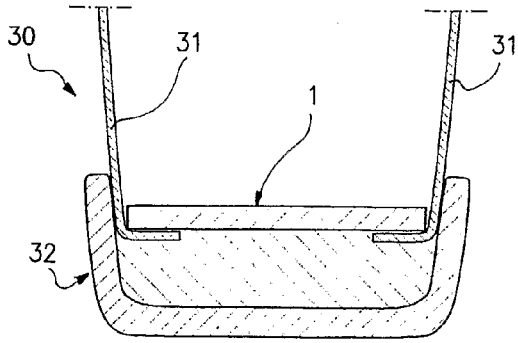
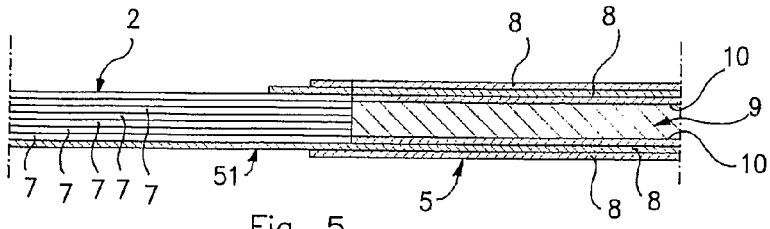
Fig. 5

INSOLE HAVING PUNCTURE-RESISTANT PROPERTIES FOR SAFETY FOOTWEAR

CLAIM FOR PRIORITY

This application is a U.S. National Stage Application of PCT/IT2006/000006 filed on Jan. 10, 2006, claiming priority to PCT/IT2005/000610 filed Oct. 19, 2005, the contents of both of which are incorporated herein by reference.

TECHNICAL SCOPE

This invention relates to a insole with puncture-resistant properties for safety footwear according to the characteristics described in the precharacterising clause of the principal claim.

TECHNICAL BACKGROUND

In the safety footwear industry the need to protect the foot within footwear from pointed and sharp objects which might penetrate through the sole and cause undesired and dangerous wounds to the user is known.

Various technical solutions have been developed with a view to solving this problem. The first of these known solutions provides for embedding a sheet of metal of suitable constant thickness in the sole. This solution does however have some disadvantages, among them the fact that this sheet imparts a constant degree of rigidity along the entire surface of the sole, increasing its overall weight and reducing the thermal insulation properties of the sole, apart from the fact that a sole with a sheet of metal is unsuitable for use in environments subject to the action of a metal detector.

Not only this, but the rigidity imparted over the entire length of the sole by the metal sheet gives rise to substantial discomfort during normal walking, particularly when walking on steps, or, to an even greater extent, on the rungs of a ladder, where the supporting surface area is restricted. This also indirectly results in less safe support for the footwear. It must be pointed out that insoles of the type mentioned here are incorporated into safety footwear normally used by persons who are very frequently called upon to use ladders with rungs, such as firemen.

A second solution which has become available as a result of continuous development in the field of polymer materials provides for the use of fabric-based insoles with enhanced properties of resistance to penetration and cutting, which may be suitably attached to the inside of the sole, for example by adhesive bonding or through the application of a separate assembly insole. Typically these insoles, which are also of constant thickness, are manufactured by superimposing a plurality of layers of fabric based on aramid fibres, which are available on the market, for example, under the trade name Kevlar®. Again the use of these insoles nevertheless gives rise to some disadvantages, including the high supply cost of the starting materials and the constant flexibility along the entire length of the insole which does not enable the insole to perform any structural function in the sole.

DESCRIPTION OF THE INVENTION

The problem underlying this invention is that of providing a insole having puncture-resistant properties which is structurally and functionally designed to overcome the abovementioned limitations with reference to the cited prior art.

In the context of this problem one object of the invention is to provide a insole which can be manufactured relatively simply and economically and which improves the performance and overall properties of the sole and the footwear in which that insole is intended to be used, in particular in terms of comfort and safety when walking.

This problem has been solved and this object has been accomplished by this invention through a insole manufactured in accordance with the following claims.

BRIEF DESCRIPTION OF THE DRAWINGS

Other advantages and characteristics of the present invention will become clear from the following detailed description of some preferred embodiments which is given with reference to the appended drawings which are provided purely by way of non-limiting example and in which:

FIG. 1 is a diagrammatical view from above of a insole having puncture-resistant properties constructed according to this invention, FIG. 2 is a view of the insole in FIG. 1 seen in transverse cross-section and on a magnified scale, FIG. 3 is a view of a sole for safety footwear incorporating the insole in FIG. 1, seen in transverse cross-section, FIG. 4 is a view of a safety shoe incorporating the insole in FIG. 1, in a diagrammatical view in partial cross-section.

FIG. 5 is a view similar to FIG. 2 of a insole according to a variant embodiment of this invention.

PREFERRED EMBODIMENT OF THE INVENTION

In FIGS. 1 to 4, 1 indicates as a whole a first embodiment of a insole having puncture-resistant properties manufactured according to the invention.

Puncture-resistant properties are determined on the basis of specific standards established at international level for the characterisation of safety footwear, such as for example European standards prEN ISO 20344:2002, which specifies the manner in which soles must be tested in order to evaluate their puncture-resistant properties, and European standard prEN ISO 20345: 2003 which establishes the minimum penetration force which soles or insoles must be capable of withstanding.

According to these standards the penetration test essentially comprises measuring the force which has to be applied to a nail of predetermined dimensions so that it is capable of perforating the insole or sole subjected to the test. This force must be equal to at least 1100 Newtons in order for the test to be satisfied.

In this context therefore, when reference is made to soles or insoles having puncture-resistant properties these are capable of passing the tests specified by the abovementioned standards, and likewise when materials having enhanced puncture-resistant properties are referred to these are materials particularly suitable for the manufacture of such soles or insoles.

Insole 1 has a shape in plan which is wholly conventional, extending along a longitudinal axis X, and on it there may be defined with reference to similar parts of the foot an anterior portion 2 extending from the toe region 3 to a metatarsal region 4, and a posterior portion 5 extending from metatarsal region 4 to a heel region 6, longitudinally opposite toe region 3.

In this context the term "metatarsal region" is to be understood to indicate the portion of insole 1 which is subjected to flexion following corresponding flexion of the foot during the stage of walking.

For the purposes of immediate understanding the regions and portions of insole 1 defined above are summarily indicated in FIG. 1.

Anterior portion 2 of insole 1 is substantially flexible, so that it suitably follows the movement of the foot when walking, while on the contrary posterior portion 5 which is not affected by flexural movements during walking is substantially rigid, such as to provide adequate structural support not only for insole 1 but also for the sole on which insole 1 is intended to be fitted or in which it is intended to be incorporated. A more thorough discussion of these advantageous features will be resumed at a later point in the description.

The opposing concepts expressed by the terms "flexible" and "rigid" in this context strictly refer to the specific behaviour of a material from which insole 1 may be manufactured when subjected to the forces acting on the metatarsal area during normal walking action. Thus a material will be defined as "flexible" when it is capable of bending by a sufficient amount to permit a step without opposing that action with specific resistance, while it would be defined as being "rigid" if that were not the case.

Flexible anterior portion 2 is preferably formed of a plurality of superimposed layers 7 made of material having enhanced puncture-resistant properties, preferably a fabric based on aramid fibres, impregnated with thermoplastic material functioning as a binder.

The number of superimposed layers 7 is selected on the basis of the characteristics and thicknesses of the individual layers, and is such as to ensure the puncture-resistant properties required from the insole. In a preferred embodiment the layers number between 5 and 10, for example 7, with an overall thickness of the anterior portion 2 of approximately 1.5-2.5 mm.

As an alternative to fabric based on aramid fibres, the use of fibres of polyolefin material with orientated molecules, obtained for example by stretching the isotropic starting material, is provided. These fibres have anisotropic characteristics with marked strength properties in a preferred direction and may be conveniently woven into a fabric having enhanced puncture-resistant properties.

In accordance with one aspect of the invention posterior portion 5 comprises at least one substantially rigid layer 8 which is manufactured of composite material formed from a fibre-reinforced polymer matrix.

Preferably this composite material is of the type having a high fibre content, of more than 50% by weight, comprising a long fibre of the continuous type impregnated with polymer resin. In a yet more preferred embodiment this fibre is glass fibre, present in the fraction by weight of between 50% and 70%, impregnated for example with epoxy, polyester or thermoplastic resin, preferably epoxy resin. Again in this case the number and thickness of the layers 8 of composite material is mainly selected on the basis of the puncture-resistant properties required.

In the light of the fact that in general the layers 8 of composite material required to impart puncture-resistant properties on posterior portion 5 of the insole have overall a thickness which is less than that of layers 7, posterior portion 5 also comprises a group of filling layers comprising a layer 9 of thermoplastic material, for example polyethylene, located between a pair of layers of non-woven fabric 10.

The group of filling layers 9, 10 is located over the entire posterior portion 5 in a position adjacent to layers 7 of anterior portion 2 and has an overall thickness which is substantially equal to that of layers 7 of aramid-fibre-based fabric.

In the preferred embodiment described here, layers 8 number 4 in all, arranged in pairs of layers 8*a*, 8*b* symmetrically arranged on the two opposing surfaces of the group of filling layers 9, 10 in such a way that they extend over the entire posterior portion 5 and also partly overlie layers 7 of aramid-fibre-based fabric in a transition zone 11.

The latter is defined in posterior portion 5 in a position immediately adjacent to anterior portion 2 and serves to ensure a holding weld between the two portions, in addition to imparting some continuity of mechanical properties between the same.

According to another feature of the invention, layers 8*a*, 8*b* of composite material extend through transition zone 11 with a surface area which decreases from the layer closest to the group of filling layers to the layer most remote from the group of filling layers. In particular it is provided that inner layer 8*a* covers the entire transition zone 11 while outer layer 8*b* only affects it partly, preferably approximately half thereof.

This feature is illustrated in FIG. 2 where for reasons of clarity in the drawing the scale ratios between the components are not respected. In particular the ratio between the thickness of layers 8*a*, 8*b* and that of the group of filling layers 9, 10 is very much less than is indicated in the drawing.

In the specific example described here transition zone 11 extends over a longitudinal length of between 2 cm and 6 cm, preferably approximately 4 centimetres.

In this way it is brought about that the mechanical properties imparted by layers 8 of composite material vary more gently and continuously on passing between posterior portion 5 and anterior portion 2.

It is likewise provided that the edge of insole 1 may be raised with respect to the principal plane defined by anterior and posterior portions 2, 5. The construction of insole 1 provides for the provision of flexible material comprising layers 7 of aramid fibre, suitably cut to form anterior portion 2 and transition zone 11 of the insole, the provision of the group of filling layers 9, 10 in a position adjacent to and coplanar with layers 7, which are suitably cut to form the posterior portion 5 of the insole. At this point a first pair of layers 8*a* of composite material based on long glass fibres impregnated in epoxy resin is provided on the two opposing principal surfaces overlying group of filling layers 9, 10 and transition zone 11, after which a second pair of layers 8*b* is placed on top of group of filling layers 9, 10 and approximately halfway through transition zone 11.

The semi-finished product so obtained is enclosed in a suitably shaped mould in which it is subjected to a pressure of approximately 4 bar and raised to a temperature of approximately 130° C. for a period of approximately 8-10 minutes in order to cross-link the epoxy resin, stiffening layers 8 of composite material. It will be noted that an effective bond between layers 8 of composite material and layer 10 of non-woven fabric and between layers 8 of composite material and layers 7 of aramid fibre-based fabric is also obtained at the same time.

In addition to permitting cross-linking of the composite material and bonding between the various components of the insole, this operation also makes it possible to suitably thermoform insole 1. The mould used will in fact be shaped in such a way as to shape insole 1 both longitudinally and transversely in accordance with a standard geometry of a last for the assembly of footwear.

Where the polymer resin of the composite material of which layers 8 are constructed is a thermoplastic resin, the operation described above, which does not give rise to any cross-linking reaction, is mainly designed to bind the components of the insole together and thermoform it.

As a result of the temperature and pressure conditions reached within the mould, the very small differences in thickness between anterior portion 2 and posterior portion 5 are substantially cancelled out, that is, in fact, insole 1 has no step in its own surfaces.

Insole 1 obtained in the manner described above may be conveniently attached to a sole 20 comprising a tread 21, for example of elastomer material. Insole 1 may be attached by adhesive bonding or by means of a layer 22 of expanded polyurethane material obtained by flow moulding.

In the latter case polyurethane layer 22 acts as both a binder between the insole and the tread, yielding a relatively deformable material which is therefore capable of imparting a greater degree of comfort to sole 20.

The special structure of insole 1 is not however restricted to imparting the desired puncture-resistant properties on sole 20, but as mentioned at the start of the description of this embodiment conveniently acts as a structural component of the same, ensuring the necessary degree of rigidity for the entire posterior part of sole 20.

It is in fact known that soles mainly constructed of elastomer material tend to deform over time bending longitudinally (a phenomenon known as "bending" of the sole). In order to prevent this it is known that a rigid member, typically a metal plate, called "cambrione" in Italian, is inserted into the posterior part of the sole. This arrangement gives rise to many disadvantages, including the fact that it has additional members with additional production and assembly costs, and makes the sole heavier. Also the mere presence of the rigid member is not normally sufficient to prevent the possibility of the sole twisting about its longitudinal axis.

The presence of insole 1 in sole 20 makes it possible to overcome these advantages, given that because of the presence of layers 8 of composite material over the entire posterior portion 5 the rigidity of the latter is sufficient to prevent deformation phenomena and longitudinal twisting of the sole.

Again thanks to the rigidity properties of insole 1 in respect of posterior portion 5, the correct flexibility of sole 20 in the metatarsal region may be achieved without the help of the rigid member and without introducing the changes in cross-section required in tread 21, as instead is the case in conventional soles, with consequent possibilities for saving of the material of which the tread is manufactured.

FIG. 4 illustrates a variant application of insole 1.

The figure shows the safety shoe indicated as a whole by 30, comprising uppers 31 and a sole 32.

Before being attached to sole 32 uppers 31 are mounted on insole 1, which is therefore used as an assembly insole for uppers 31. It will be noted therefore that insole 1 makes it possible to provide a safety shoe saving both the assembly sole for the uppers and the rigid member and other structural or stiffening members for the sole, rendering its manufacture less costly and simpler.

FIG. 5 shows a insole 50 comprising a variant embodiment of the insole described above with reference to FIGS. 1 to 4. For greater clarity the details of insole 50 corresponding to similar features in insole 1 will be identified using the same reference numbers as used previously.

Insole 50 differs from insole 1 in the fact that in addition to layers 7 of aramid fibre-based fabric it comprises a further protective layer 51 extending over the anterior portion 2 of insole 50. Optionally layer 51 may also extend over posterior portion 5 of insole 50.

Protective layer 51 is made of compact material, that is substantially devoid of holes or any other through openings, and sufficiently flexible not to compromise the flexibility properties specific to anterior portion 2.

The function of protective layer 51 is to constitute an effective barrier to the action of particularly slender sharp objects. It has in fact been found that the protection against puncture provided by superimposed layers 7 of aramid fibre-based fabric, although certainly adequate and sufficient to pass the standard tests to which soles for safety footwear are subjected, may not be entirely satisfactory if the sharp object has a particularly small diameter, such as for example a very slender steel nail.

In this case it is in fact possible for the tip to pass through one or more of the layers of aramid fibre taking advantage of the holes present in the weave of the fabric.

The provision of protective layer 51 advantageously makes it possible to prevent this possibility, providing an effective barrier against this type of object: in fact even if it is not sufficient to block penetration of the object into the sole by itself, it is normally able to deform it, bend it or break its tip so that it is no longer possible to pass through layers 7 via the holes in the aramid fibre fabric.

At this aim layer 51 is preferably applied to anterior portion 2 on the side of the sole which is designed to face outwards when fitted to the shoe.

Protective layer 51 may be constructed of a thin sheet of metal material, for example aluminium, of a thickness between 0.15 and 0.30 millimetres, sufficient for the barrier effect required, and at the same time sufficiently thin to ensure the necessary flexibility for anterior portion 2. It is known that the metal sheets commonly used in puncture-proof insoles of safety footwear have thicknesses between 0.75 and 1 mm, and are too rigid for the purposes proposed. On the contrary, the metal sheet used in insole 50 may continue to have a very reduced thickness because the puncture-preventing function proper is delegated to layers 7 of aramid fabric.

Even more conveniently, protective layer 51 may be constructed from one or more of layers 8 of composite material provided in posterior portion 5, which may be extended until they also cover anterior portion 2 (the arrangement specifically illustrated in FIG. 5). Of course the number of layers 8 which also extend into anterior portion 2 will be gauged in relation to the required flexibility thereof and, in particular, it will necessarily be less than that specified for posterior portion 5, which is completely rigid.

In practice it has been found that a number of layers 8 equal to one or two is sufficient to ensure both the barrier effect required for protective layer 51 and sufficient flexibility of the insole in its anterior portion 2.

In comparison with the solution using metal sheet, the use of layers 8 of composite material makes possible a process for the production of insole 50 which is on the whole simpler and less costly.

The use of insole 50 as a component of a sole or safety footwear is wholly similar to that of insole 1, which has been described in detail previously.

This invention therefore overcomes the problem mentioned above with respect to the cited prior art, while at the same time offering many other advantages including the possibility of manufacturing a lighter sole and shoe without metal components, which is more comfortable and safe than conventional soles and footwear.

Another advantage is provided by the possibility of saving very costly aramid fibre material, restricting its use to only the anterior portion of the insole.

Another advantage is provided by the possibility of regulating the point of flexure of the sole from the outset, by altering the length of the anterior and posterior portions in order to obtain the most comfortable walk possible.

The invention claimed is:

1. An insole with puncture-resistant properties for safety footwear, comprising an anterior portion extending from a toe region to a metatarsal region of said insole and being formed of a substantially flexible material comprising at least one layer formed of polymer fibres having enhanced puncture-resistant properties, a posterior portion extending from said metatarsal region to a heel region longitudinally opposing said toe region and comprising at least one substantially rigid layer made of composite material formed from a fibre-reinforced polymer matrix as well as a group of filling layers located in a position longitudinally adjacent to said substantially flexible material, so that the posterior portion has substantially the same thickness as the anterior portion.

2. The insole according to claim 1, wherein said at least one layer of polymer fibres having enhanced puncture-resistant properties is based on aramid fibres or polyolefin fibres with orientated molecules.

3. The insole according to claim 2, wherein at least one layer of polymer fibres having enhanced puncture-resistant properties is based on aramid fibres.

4. The insole according to claim 3, wherein said anterior portion comprises 5 to 10 layers of aramid fibre fabric superimposed on each other and impregnated in a thermoplastic resin.

5. The insole according to claim 1, wherein said composite material comprises long fibre of a continuous type in a percentage of more than 50% impregnated with thermoplastic, epoxy or polyester polymer resin.

6. The insole according to claim 5, wherein said composite material is formed from glass fibre impregnated with epoxy resin, said glass fibre being present in a percentage of between 50% and 70% by weight.

7. The insole according to claim 1, wherein said composite material extends over the entire posterior portion.

8. The insole according to claim 1, wherein said composite material and said substantially flexible material overlap only in a transition zone defined in the posterior portion of the insole in a position immediately adjacent to the anterior portion.

9. The insole according to claim 8, wherein said group of filling layers has substantially the same thickness as said flexible material, said at least one layer of composite material overlying said group of filling layers and said substantially flexible material within said transition zone.

10. The insole according to claim 9, wherein several layers of composite material are provided, said layers extending within said transition zone with a surface area which decreases from the layer most proximal to the group of filling layers to the layer furthest from the group of filling layers.

11. The insole according to claim 1, wherein there are provided two pairs of layers of composite material located symmetrically on opposing principal surfaces of said group of filling layers.

12. The insole according to claim 1, wherein said group of filling layers comprises a layer of thermoplastic material located between a pair of layers of non-woven fabric.

13. The insole according to claim 1, wherein said anterior portion comprises a protective layer associated with said at least one layer formed from polymer fibres having enhanced puncture-resistant characteristics, so as to protect said anterior portion from perforation by slender sharp objects which are likely to pass through said at least one layer between said polymer fibres.

14. The insole according to claim 13, wherein said protective layer comprises a sheet of metal material.

15. The insole according to claim 14, wherein said sheet comprises aluminium and has a thickness between 0.15 and 0.30 millimetres.

16. The insole according to claim 13, wherein said protective layer comprises at least one layer of composite material.

17. The insole according to claim 16, wherein a plurality of layers of composite material are provided in said posterior portion, at least one of said layers also extending into said anterior portion so as to form said protective layer.

18. The insole according to claim 13, wherein said protective layer is provided with respect to said at least one layer formed of polymer fibres having enhanced puncture-resistant characteristics on the side of said insole which is designed to face the exterior when the latter is fitted to a safety footwear.

19. A sole for safety footwear, comprising an external tread and an insole according to claim 1 having puncture-resistant properties attached to said tread on a side of said sole facing a user's foot.

20. A sole according to claim 19, wherein said insole is attached to said tread by means of a layer of expanded polyurethane material extending between said tread and said insole.

21. Safety footwear comprising a sole according to claim 20.

22. Safety footwear comprising a sole according to claim 19.

23. Safety footwear comprising an insole according to claim 1.

24. Footwear according to claim 23, comprising uppers attached to an assembly insole, said assembly insole being an insole with puncture-resistant properties constructed according to claim 1.

* * * * *